US006311976B1

(12) United States Patent
Yoseloff et al.

(10) Patent No.: US 6,311,976 B1
(45) Date of Patent: Nov. 6, 2001

(54) VIDEO GAME WITH BONUSING OR WILD FEATURE

(76) Inventors: Mark L. Yoseloff, 1900 Grey Eagle St.; Russell B. Dunn, 3003 La Mesa, both of Henderson, NV (US) 89014; Josef Alexander Hartl, 509 Escoto Pl., Henderson, NV (US) 89012

( * ) Notice: Subject to any disclaimer, the term of this patent is extended or adjusted under 35 U.S.C. 154(b) by 0 days.

(21) Appl. No.: 09/654,193

(22) Filed: Sep. 1, 2000

(51) Int. Cl.[7] ..... G07F 17/34

(52) U.S. Cl. ..... 273/138.2; 273/143 R; 463/20

(58) Field of Search ..... 273/138.2, 143 R, 273/292; 463/12, 13, 20

(56) References Cited

U.S. PATENT DOCUMENTS

| | | | | |
|---|---|---|---|---|
| 4,648,600 | * | 3/1987 | Olliges | 273/138 |
| 4,871,171 | | 10/1989 | Rivero . | |
| 5,042,818 | * | 8/1991 | Weingardt | 273/292 |
| 5,067,712 | * | 11/1991 | Georgilas | 273/143 R |
| 5,085,435 | | 2/1992 | Rossides . | |
| 5,257,784 | | 11/1993 | Boylan et al. . | |
| 5,308,065 | | 5/1994 | Bridgeman et al. . | |
| 5,332,228 | | 7/1994 | Schultz . | |
| 5,393,057 | | 2/1995 | Marnell, II . | |
| 5,449,173 | * | 9/1995 | Thomas | 273/143 R |
| 5,489,101 | | 2/1996 | Moody . | |
| 5,560,603 | | 10/1996 | Seelig et al. . | |
| 5,580,311 | | 12/1996 | Haste, III . | |
| 5,620,182 | | 4/1997 | Rossides . | |
| 5,749,784 | | 5/1998 | Clapper, Jr. . | |
| 5,816,915 | | 10/1998 | Kadlic . | |
| 5,816,918 | | 10/1998 | Kelly et al. . | |
| 5,823,534 | | 10/1998 | Banyai . | |
| 5,823,873 | | 10/1998 | Moody . | |
| 5,823,874 | | 10/1998 | Adams . | |
| 5,848,932 | * | 12/1998 | Adams | 463/20 |
| 5,851,148 | * | 12/1998 | Brune et al. | 463/25 |
| 5,868,618 | | 2/1999 | Netley et al. . | |
| 5,868,619 | | 2/1999 | Wood et al. . | |
| 5,882,259 | | 3/1999 | Holmes, Jr. et al. . | |
| 5,882,261 | * | 3/1999 | Adams | 463/20 |
| 5,911,418 | | 6/1999 | Adams . | |
| 5,947,820 | * | 9/1999 | Morro et al. | 463/9 |
| 5,980,384 | | 11/1999 | Barrie . | |
| 6,004,207 | | 12/1999 | Wilson, Jr. et al. . | |

(List continued on next page.)

FOREIGN PATENT DOCUMENTS

| | | |
|---|---|---|
| 4361397 | 2/1998 | (AU) . |
| 2066991 | 7/1981 | (GB) . |
| 2181589 | 4/1987 | (GB) . |
| 9732285 | 9/1997 | (WO) . |

OTHER PUBLICATIONS

Declaration of Josef Alexander Hartl Mar. 15, 2001.

Declaration of Josef Alexander Hartl; Dated Mar. 1, 2001.

*Primary Examiner*—Benjamin H. Layno
(74) *Attorney, Agent, or Firm*—Mark A. Litman & Associates P.A.

(57) ABSTRACT

A method of playing a wagering game comprises placing a wager in a reel-type video wagering game, and playing a first game segment in the reel-type video wagering game in which symbols are randomly displayed to the player. At least some displayed symbols may be non-monetary credit symbols, and after playing the first game segment, the player may accumulate the non-monetary credit symbols. Upon the occurrence of a special feature or event, a monetary value is randomly assigned to the non-monetary credit symbols, and a payout is resolved, based at least in part on the monetary value assigned to the non-monetary credit symbols. The method may have the player accumulate non-monetary credits in a first game segment, and the random assignment of a monetary value or values to the non-monetary credits occurs in a second game segment.

39 Claims, 8 Drawing Sheets

U.S. PATENT DOCUMENTS

| | | | | |
|---|---|---|---|---|
| 6,007,066 | | 12/1999 | Moody . | |
| 6,015,344 | | 1/2000 | Kelly et al. . | |
| 6,015,346 | * | 1/2000 | Bennett | 463/20 |
| 6,056,289 | | 5/2000 | Clapper, Jr. . | |
| 6,059,289 | | 5/2000 | Vancurra . | |
| 6,059,658 | | 5/2000 | Mangano et al. . | |
| 6,068,552 | | 5/2000 | Walker et al. . | |
| 6,089,978 | * | 7/2000 | Adams | 463/20 |

* cited by examiner

VIDEO GAME WITH BONUSING OR WILD FEATURE

BACKGROUND OF THE INVENTION

1. Field of the Invention

The present invention relates to the field of video gaming systems, particularly video gaming systems where payouts are awarded for the appearance of symbols, and video gaming systems with bonus payout features.

2. Background of the Art

Video wagering games are popular gaming devices in casinos and other gaming establishments. A number of factors have contributed to the popularity of video wagering games. Gaming establishments have expanded the variety of games offered on video platforms beyond what was once limited to video poker, video keno and video reel slot machines. Many casino table games such as blackjack, draw poker, stud poker, Let It Ride® poker and Caribbean Stud Poker® are available on video. These games can be learned on video machines before advancing to the more intimidating live table game environment. With video wagering, novice players can enjoy playing a wide variety of casino games without having to play at a table with other more experienced players who may create an intimidating environment for the novice. Players of video games need not worry about playing too slowly to suit the dealer or other players or about feeling embarrassed by making a particular strategic decision.

Video wagering games often are capable of paying a progressive jackpot if the player achieves a predetermined winning outcome, which offers the anticipation or hope for a very large award. Progressive jackpots for gaming machines became popular in part because the technology was available to account for the jackpot amount. For the above reasons, the video wagering format is growing at a pace which exceeds the growth of play of live casino table games and other types of live wagering.

One of the more commonly known video wagering games is video draw poker which is available in numerous variations. Other examples include video reel slot machines and video keno. Video reel slot machines may simulate the play of a mechanical slot machine such as a three-reel slot, for example. Because the virtual reels in a video gaming apparatus are not limited by the geometry of a conventional slot reel, the game can provide a larger number of pay lines or of winning combinations than can a conventional mechanical slot machine.

Numerous versions of video poker are available, including numerous versions of draw poker, stud poker, Let It Ride® poker, Caribbean Stud®, and more recently, Triple Play Poker™. Some video platforms are provided with the capability of the player being able to select from among a number of video wagering games. For example, some gaming establishments provide a number of poker game variations on one multi-game video platform. The games are played independently, one-at-a-time, with no interrelationship between games.

Some video games which are adapted for play on a home computer have a "second screen" feature. That is, if the player wins a certain number of games, or achieves a predetermined skill level in a game, a second screen will appear which either permits the player to play the same game at a higher skill level or allows the player to engage in a special feature of that game (e.g., collect additional game pieces or increased lives, as in Mario Brothers® arcade games). In the case of video wagering, there are a growing number of video wagering games which provide an opportunity to first play an underlying or principal video wagering game (e.g., draw poker) and then to play a different wagering game, although on the same video screen format as the poker game (e.g., as with "double down" games as known in the art). For example, some video poker games offer a double-or-nothing feature. If a player has a winning hand in the first segment of the game, the player can optionally risk the amount won by trying to determine whether a given card will be higher or lower than 8. Alternatively the player may have to choose one of four cards in an attempt to get a card higher than one already shown. If the player wins, his original bet is doubled. He may continue to "double up" until he reaches some predetermined limit, or loses. However, if he loses, he loses the winnings from the first game. This "double up" game is played on substantially the identically formatted screen (showing five playing cards, but with the possible addition to that screen of alphanumerics, as later described) as is the underlying poker game. The principal game, the poker game, is played to obtain an award, and only that award allows winnings from that single game to be "doubled up."

There also exist video wagering games that have a video slot segment and at least one additional video wagering segment. Additionally, there are known second, that is alternative screen games in which the winnings from the second screen game are unrelated to and independent of the winnings in the first screen game.

Examples of these games are U.S. Pat. No. 4,871,171 (Rivero) showing a slot game with a lottery-type second game showing a cage with balls that are used to select a prize, including a consolation prize; U.K. Patent No. 2,066,991 A (Middleton) showing a reel slot game followed by the play of a pin ball or Pachinko-type game in which the movement or rest position of a ball indicates an influence over the award for the slot game, including the award of a jackpot; U.S. Pat. Nos. 5,848,932; 5,911,418 and 5,823,874 describe a card game or slot game in which after achieving a predetermined result in the play of a first game, a bonus round is entered in which a roulette-type spin of a ball determines a payout or bonus amount, beyond what is achieved in the play of the slot game.

Applicant's commonly assigned co-pending U.S. patent application Ser. No. 08/820,438, filed on Mar. 12, 1997 titled "Method Of Scoring A Video Wagering Game" describes a second screen video game in which winnings or awards from the play of a first game on a first format screen may be increased or multiplied by play of a second game on a second screen with a different visual format than the first screen.

It is well known in the gaming industry that bonus games attract and keep players at a gaming machine. The bonus game is typically another gaming machine or a random selection device which is enabled by a bonus qualifying signal from an underlying or primary gaming machine. A wide variety of bonus games, features, and devices are known some of which are set forth next.

The conventional WHEEL OF GOLD® and WHEEL OF FORTUNE® slot casino games incorporate a single play bonussing feature. A rotating wheel is activated by the player depressing a bonus spin button when certain indicia appears on the reels of the slot game and is used to award bonus payouts in a spin of the wheel. A separate multiplier may be used to multiply the bonus payouts. After the bonus spin, play resumes in the underlying gaming machine. These games are commercially available from Anchor Gaming and International Game Technology and are disclosed in U.S. Pat. Nos. 5,823,874 and 5,848,932.

U.S. Pat. No. 6,004,207 describes a spinning reel slot machine that gives a multiplied payoff when certain conditions are fulfilled. Wins that include a special symbol on the pay line are multiplied by an incremental multiplier when the machine is in a particular mode. A counter value is increased by one every time a second special symbol appears on the visible sections of the reels. Whenever the counter reaches a predetermined value, the counter is reset and the multiplier is increased. Whenever a multiplied payout occurs, the multiplier is reset to a minimum value. An "XFACTOR" may act as a wild card for reel slot symbols and may also include other functions in the play of the game.

U.S. Pat. No. 5,980,384 describes an embodiment of the invention in which the player initiates a round of a reel slot type machine game (often referred to as a "spin" or "play") by pulling the slot machine handle or pushing a button and waiting for the reels to stop spinning. If a row of common symbols appear, which may include wild card symbols such as Jokers, in the primary game the player has a win. In variants of the primary game where there are multiple rows of symbols displayed, if a column or diagonal line of common symbols appear in the primary game, the player has a win or gains some other game advantage.

U.S. Pat. No. 6,059,658 describes a device and method for playing a primary and a secondary, bonus game are set forth which includes a primary game device and a secondary game device having a display having five concentrically arranged wheels each having an indicia of an Ace, King, Queen, Jack, Ten and a wild symbol. In response to receiving a pre-selected bonus outcome during play of the primary game device the secondary game device is actuated to rotate the wheels and randomly present an indicia from each wheel at a pay line as a secondary outcome. The outcome of the secondary game device can be used as an additional award or to multiply the award for the bonus outcome in the primary game.

U.S. Pat. No. 5,393,057 pertains to an electronic gaming apparatus and method therefore wherein each play in the bonus made is the result of successive underlying game play. The invention teaches the use of an electronic primary gaming device such as a poker or a slot machine and an electronic secondary gaming device based on bingo. When a winning combination such as three queens appears in the primary game, a space in the bingo matrix is turned over to reveal a bingo symbol. Play continues on the primary game until a winning sequence occurs in the bingo game. The right to play the bingo secondary game does not occur unless the player inserts three or more coins into the primary game. Play continues until the game achieves a bingo in which case the player receives a prize. UK Patent Application GB 2181 589 A published Apr. 27, 1987 pertains to a slot machine having a jackpot feature whereby the prize value is transferred between separate jackpot displays as successive games are played. Some of the reel symbols are overprinted with a number and when that number lands on the pay line, it is used to climb a ladder. The ladder enables the player to obtain one or all of the prizes in the upper portion of the slot machine. For example, if the overlaid number lands the player on a first playing level, then the player receives all three prizes. If the overlaid number lands the player on a second level, then the player can select which one of the three prizes to receive. If the player lands on a third level, then it becomes a game of skill to select which of the three prizes he selects. Finally, if the player lands on a fourth level, then the prize is randomly selected. The prize may also be randomly doubled. U.S. Pat. No. 5,560,603 sets forth a plurality of slot machines interconnected to an electronic controller which displays a separate race game. Each time a particular predetermined combination of indicia appears in the display of a particular slot machine, a signal is generated from the slot machine which advances the racing element through a particular predetermined distance. If the player's horse reaches the finish line before a timer display times out, then the slot player wins an additional prize. The players in this patent are not racing against each other, but against a clock.

U.S. Pat. No. 5,823,534 discloses a bingo format of game with a wild feature. A bingo game for being played by a plurality of players employing a table having respective player stations thereabout. The game permits each player to select each of his or her numbers to be matched during play by randomly drawn numbers, including a wild designation which each player may deem to match one of his or her selected numbers, and the game is permitted to progress at multiple levels of play notwithstanding the occurrence of prior bingos in the game being played.

Many video gaming systems provide wild symbols, usually wild cards, in the play of their games. Examples of these wild symbol games include, but are not limited to, U.S. Pat. Nos. 6,007,066; 5,882,259; 5,823,873; 5,868,618; 5,868,619; 5,816,915; 5,489,101; and U.S. Pat. No. 5,332,228 describes an improved stud poker game that requires no decisions from the player after the initial bet is placed. Each hand has one guaranteed wild card that appears at a card position which is predetermined, and shown to the player, before the player's cards are dealt. In addition to the one guaranteed wild card, all like valued cards in the hand are also wild. Also, there are a number of novel and entertaining ways to determine the wild card position. The game is adaptable to both video play and table play formats.

U.S. Pat. No. 5,308,065 describes a casino table card game where a player, after making a wager, is dealt, face-up, a hand of five cards that is placed in a player-hand area. The player also receives a solitary card, which is dealt face down in a single-card area. The player then has a chance to improve the ranking of the five-card hand by discarding up to five cards and replacing them with an equal number of new cards. After the player rearranges the five-card hand, the solitary card is turned face-up and all the cards in the player's hand that have the same face value as the solitary card are designated wild. The ranking winnings are calculated according to a statistical pay table.

U.S. Pat. No. 5,257,784 discloses a method and apparatus for playing a wagering game including a usual play of the game whose outcome is determined by a selection of usual randomly generated symbols. Added to the usual symbols is at least one and preferably a plurality of additional, preferably no-value, symbols. The wagering game is then played by wagering on the usual play of the game and additionally by wagering on a chance occurrence of one and preferably at least two of the additional symbols being selected during the usual play. The wagers on the chance occurrence are settled according to the outcome of the chance occurrence, and the usual wagers are similarly settled depending on the outcome of the usual play of the game. In one preferred embodiment, the wagering game is a usual card game so that the usual chance generated symbols are a deck of value playing cards. The additional symbols are then at least two no value playing cards which are added to the deck. In other embodiments, the usual symbols are representations of such cards, numbers, or other symbols of significance. Besides dealing of the symbols, the use of ball and grid selection devices, an electronic selection device with a video display, or a lottery mixing and picking device are possible. In one method of play, the chance wagering is made after an additional card is dealt. Alternatively, the chance wager can be made before any cards are dealt. In either event, after an additional card is dealt, further cards are dealt until a value card is dealt to replace the initially received additional card, so that the additional card or cards dealt can be discarded and the usual game continued. As a further alternative, the receiving player of an additional card can be presented with a choice of using the additional card as a wild card or of making a chance wager on whether or not the next card which will be dealt to him will be another additional card. In a casino type game, this choice can be accompanied with the requirement that a receiving player desiring to use the additional card as a wild card buy the additional card.

U.S. Pat. No. 6,068,552 discloses a gaming device such as a video based slot machine that provides a player the ability to modify at least one parameter of the slot machine. The slot machine then modifies other parameters to ensure a desired house advantage. Odds, payout schedules and wager amounts may be customized by a player, and the slot machine automatically determines changes in other parameters which were not customized to maintain a constant house advantage. Software running on the slot machine uses an equation that takes into account pertinent parameters or variables such as size of jackpot, amount wagered taken in at each pull, and probability of hitting the jackpot at each pull. Based on the equation, the software adjusts parameters other than the one(s) specified by the player so that the outcome (the house advantage) remains constant with each pull. A player interface provides an easy to use method of modifying selected parameters.

U.S. Pat. No. 6,059,289 discloses a method for playing a bonus game in a secondary slot machine adjacent a primary slot machine. The primary slot machine issues a bonus qualifying signal to the secondary slot machine to start play of a bonus game when a bonus qualifying event occurs. The reels of the bonus game include value symbols, null symbols, and end game symbols which may be of two basic types: a lose game symbol and a stop game symbol. After the random spin, the values of any value symbols displayed on the pay line of the secondary slot machine are accumulated into an accumulated winning value. The value symbols could include positive integer values, negative integer values, and multiples. The random spinning, determination of values of any value symbol and the accumulation of a winning value is repeatedly continued until an end of the bonus game occurs.

Australian Patent Application Serial No. 18618/97, filed Feb. 28, 1997 and published Sep. 4, 1977 and Australian Petty Patent No. 686556, filed Oct. 29, 1997, published and granted on Feb. 5, 1998, both titled "Slot machine with roaming wild card" and assigned to Aristocrat Leisure Industries Party LTD describes a slot machine and method play in which there may be a triggering predetermined event in a reel-slot type (including video formats) wagering game. The triggered event is the display of a wild card symbol in a first display location. The wild card symbol is then progressively moved one space at a time to a predetermined number of other display positions. The display event of the wild card may include a symbol (a penguin is described in the patent application) that 'walks' from adjacent space to space on the reel, with any awards determined for the single wild symbol being positioned at each location on the screen. Among the most detailed sequence of events employed in one embodiment comprises the steps of showing a triggering symbol to initiate the progressively moving wild symbol feature. The number of lines and amount of wager are carried over. Sounds accompany the progressively moving wild symbol feature. The moving wild symbol changes back-and-forth between images (e.g., an iceberg and a penguin). The win meter increments for each partial pay feature.

There is significant patent art as well as background art in the accrual of nonmonetary credits, although for the most part these prior art credits tend to be different from the 'payment credits' (that is, credits that are used by the apparatus to compute a token/credit award during resolution of the video/reel game).

For example, U.S. Pat. Nos. 6,056,289; 6,015,344; 5,816,918 are related patents and U.S. Pat. No. 5,749,784 is a distinct patent that describe playing a reel/video game where vouchers or credit redemption tickets are awarded for play of the game. The tickets are then redeemed at a different location after sufficient tickets have been awarded.

Similarly, U.S. Pat. No. 5,580,311 awards a player game tickets for favorable outcomes in the play of a video game.

U.S. Pat. No. 5,947,820 allows a player to collect pieces of a puzzle (a nonmonetary award) that are used to eventually complete a puzzle for an award.

U.S. Pat. Nos. 5,620,182 and 5,085,435 describe a game in which the player accumulates the rights to purchase commodities.

Other games that are played in casinos that disclose related technology include "Bingo-type" games in which the appearance of bingo numbers on the reels in frames that are in play are accumulated and assigned to their respective positions on a display of a bingo card on an overhead screen (in effect a non-monetary award, but not a credit). A bonus award is given to the player when a bingo is achieved on the screen.

Similarly in the Press Your Luck™ video game, the award of the characters (which indicate the number of bonus plays that have been awarded) is a form of non-monetary credit/award. Also in the Williams Gaming Monkey Kong™ game shown at the 1998 International Gaming Trade Show in Las Vegas, Nevada the monkey was advanced non-monetary positions up a building, attaining a bonus when the top of the building was reached.

Williams Gaming showed a game in September, 1999 at the World Gaming Expo in Las Vegas, Nev. called BOOM™ in which fire cracker symbols are accumulated in the base game. When a predetermined number of symbols are accrued, the bonus event is triggered. The non-monetary credits are not carried forward into the play of the bonus game.

SUMMARY OF THE INVENTION

A novel feature for a video gaming apparatus of the reel-slot-type configuration is provided. In the play of the game, one or more non-monetary credits accumulate. Upon the occurrence of a triggering event, the non-monetary credits are assigned a monetary value and a payout is made to the player. The event or events triggering the assignment of a monetary value to non-monetary credits may be the appearance of one or more preselected symbols on the display. Special wild symbols may also appear in the play of the game. The special wild symbols are capable of morphing into another game symbol, a non-monetary credit symbol or both. The game results are then evaluated to determine if winning combinations of symbols have been provided by the original symbols and/or the addition of wild symbols by operation of the gaming apparatus and gaming method. Additionally, the game payout is a function of the assignment of a monetary value to accrued non-monetary credit symbols.

In one example of the invention that will be described in detail herein with regard to a game styled as "SLOT MARKET" representing concepts familiar to the stock market and other economic markets, the screen display in the reel-slot-type video game is a video representation of five horizontally aligned reels, with three rows of frames. Each "reel" shows three symbol positions aligned vertically, with five reels aligned horizontally, for a total of fifteen symbol positions on the screen display.

DETAILED DESCRIPTION OF THE INVENTION

Figure 1:
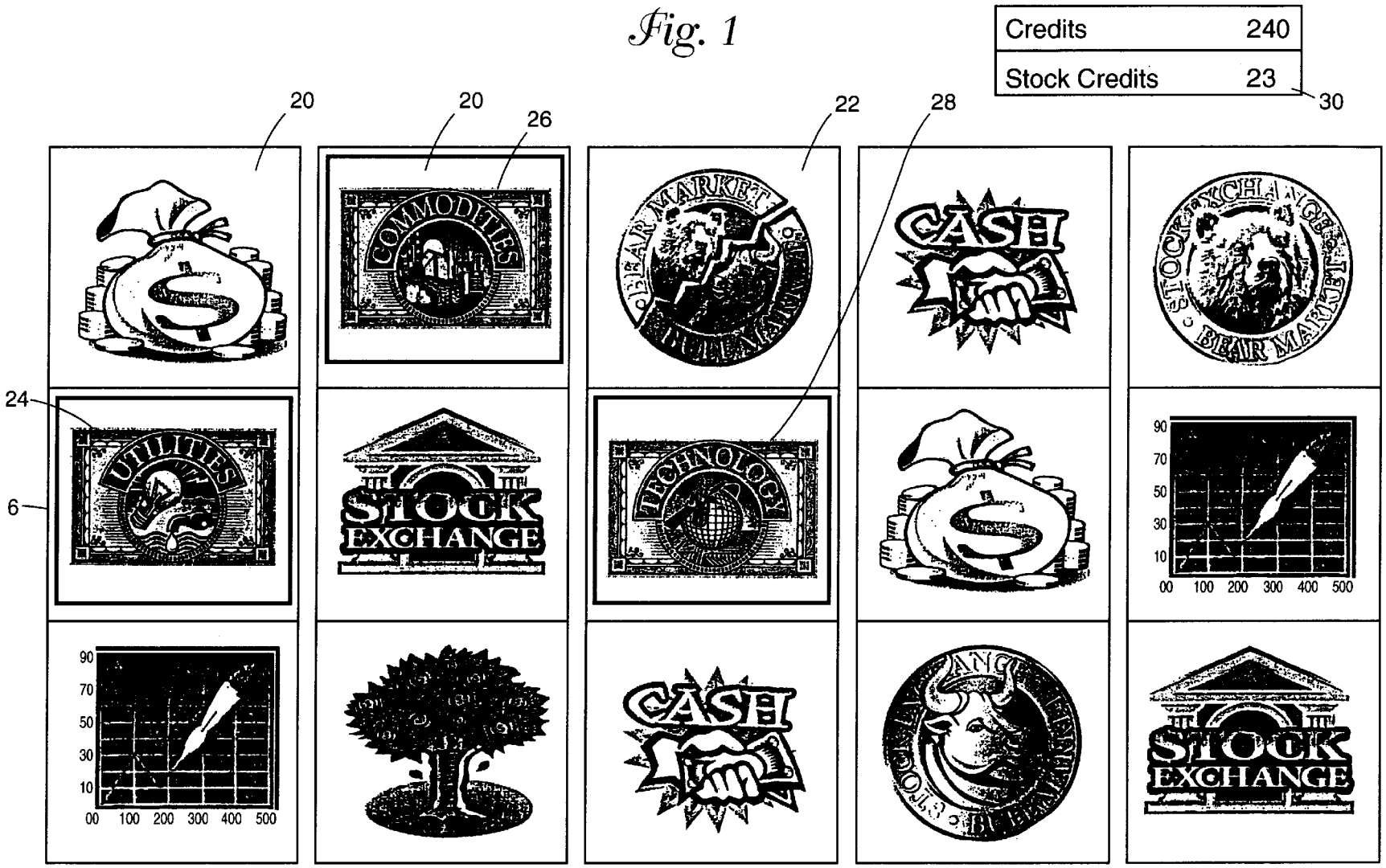
FIGS. 1 and 3 are screen displays of a first game segment of the present invention.

A method of playing a video wagering game comprises a player placing a wager on a first reel-slot-type video game and; displaying a plurality of randomly selected game symbols on a display, each symbol appearing in a designated symbol position. Upon the occurrence of a predetermined triggering event, awarding at least one type of non-monetary credit (or a temporary/artificial credit having no immediately redeemable cash or prize value) to the player; 1) at the conclusion of the first game, 2) at the conclusion of a number of first games, 3) upon the occurrence of a second triggering event, 4) after collection of a predetermined number of at least one type of non-monetary credits during the first game, or 5) after collection of non-monetary credits during a set time period. The method includes assigning a unit value or total value to the non-monetary credits, and resolving the award to the player regarding the non-monetary credit. The triggering event is preferably the initiation of a bonus event or jackpot event in which distinct amounts of credits previously accrued or won in the play of a basic reel-slot-type video wagering game are carried forward into a bonus event. The bonus event is fundamentally different from the play of the basic reel-slot-type wagering game, with the first game being a reel-slot-type video wagering game and the bonus event being an event where 'value' is assigned to at least some of the accumulated non-monetary credits. The bonus event has the preferred option of placing no monetary credits at risk, although the monetary value established for at least one non-monetary credit may be set at zero.

Another aspect of playing a novel wagering game comprises providing one or more symbols whose appearance alone or in a predetermined combination (combination of numbers on a screen, order on a screen, position on a screen, or a combination of number, order and position) that triggers an award of a non-monetary credit. Wild symbols are also provided that may be wild only with respect to certain game symbols and may additionally trigger an award of a non-monetary credit.

Among the novel attributes of the play of this game may be individual, and not necessarily collective or jointly required features of:

1. Accruing non-monetary credits:
   a) where the non-monetary credits are converted to game/token credits in an event that occurs within the gaming apparatus. This is opposed to certain old style games where tickets or ticket credits are accumulated and a cashier awards the tickets.
2. Accruing different types of non-monetary credits in a base game, each of which type of credit may be valued in proportion to credits earned, or differently at a later stage of the game or in a bonus event.
3. Accruing at least one type of non-monetary credit with as little as a single symbol appearing on the screen (e.g., as a scatter award).
4. Randomly assigning a monetary value to each non-monetary symbol after conclusion of a base game, either before or after resolution of monetary awards in the base game (the reel-slot-type first game) and/or before, during or after resolution of a bonus event.
5. Randomly assigning an "opening" and then a "closing" monetary value to each type of symbol before resolution of awards. This may include showing a first value for at least one non-monetary credit in terms that establish a conversion factor to monetary/game credits, and then varying that first value at least once until a final second value is shown for at least one value or conversion factor to monetary/game credits.
6. Summing the monetary value of each type of non-monetary credit symbols, and then multiplying the number of non-monetary credit symbols accrued with a conversion factor to a monetary/game credit value, and resolving an award of non-monetary credit values by crediting a monetary/game credit value on the meter used in the base game.
7. Providing wild symbols that morph or change into symbols designating an award of a non-monetary credit, into other game symbols or both.

As noted above, there is significant patent art as well as background art in the accrual of non-monetary credits, although for the most part these prior art credits tend to be different from the 'payment credits' (that is, credits that are used by the apparatus to compute a token/credit award during resolution of the video/reel game). For example, U.S. Pat. Nos. 6,056,289; 6,015,344; 5,816,918; 5,749,784; 5,580,311; 5,947,820; 5,620,182; 5,085,435; display non-monetary credits of one form or another. Other games that are played in casinos that disclose related technology include the "Bingo" game and "Press Your Luck™" video game show a form of non-monetary credit/award. In the Press Your Luck™ game play method, three or more "whammy" symbols in the first game segment trigger a bonus event. The number of bonus "spins" awarded to the player corresponds to the number of "whammies." In this sense, each whammy has a value of one spin.

These games indicate that the nature of the non-monetary credit must be accurately defined to assure that the known art is clearly distinguished. The term "nonmonetary credit" is defined as a credit or an award that at the time the nonmonetary credit is awarded, has no intrinsic value that can be converted by the apparatus to a token/credit value that can be paid out by the apparatus. This is in contrast to a game with a "double or nothing" feature. In this instance, the player has already accrued a monetary award, and simply puts it at risk in additional game play step (double or nothing). The prior art references reviewed above either require 1) a payout distinct from the apparatus (e.g., the presentation of tickets, a jackpot such as an automobile), 2) that the award is collected towards attaining a bonus (e.g., numbers on a bingo board, letters in a word game, etc.) or 3) the award is itself tokens/credits. Additionally, there are progressive jackpots or mini-progressive jackpots where credits are accumulated toward bonus or jackpot events, including "Mississippi Belle™ Hidden Bonus" draw poker, where credits are randomly accumulated in a jackpot, and the player sporadically competes with a virtual dealer for the jackpot. The game remains as draw poker in the bonus (although there is a competition only in the jackpot), and the jackpot has a defined monetary credit value. This is quite distinct from the present invention where nonmonetary credits are accumulated towards the play of a special feature or event where the value of the credits are established only in that event.

Among the other novel features available in the play of this game are at least accruing non-monetary, non-refundable credits during play of the base game including the possibility of accruing non-monetary credits with as little as a single symbol appearing on the screen (e.g., as a scatter award) and randomly assigning a monetary value to each symbol after conclusion of the base game, but before resolution of the awards. Additionally, such features may be added in this aspect of the game where the accumulated credits will expire after an extended period of time (to prevent players from 'shopping' for machines with larger credit amounts.) Alternatively, the apparatus may respond to the identification card of a player so that any credits that player accumulates will be used in the play of the game and the bonus only with that particular player. This methodology has significant advantages as players may end their play for the day and return within an allowable time period, such as within twenty-four hours, and restart the game at the same credit status that they left the game with yesterday. With casinos regularly monitoring the play of individual players on networked computer systems, this would be a readily established capability.

Another unique aspect of the invention is randomly assigning an "opening" and then a "closing" monetary value to each type of symbol before resolution of monetary awards. This feature appears to be completely new to the gaming industry. This feature is useful with a number of different imagery formats, and would not be limited exclusively to a stock or certificate based format. Grain stalks could be used with changing values, fruits, precious metals, gems, houses, etc. could also have variable property values that changes in the resolution of the non-monetary credits. There would be a single display with a changing value for each of the symbols or multiple displays for each of the commodities, or a single display for only so many of the non-monetary credits that are under consideration for valuation in the bonus round. The closing price would determine the monetary credits finally won. The actual variation of value of the nonmonetary credit varying with time in a post-game, end-game, or bonus resolution is also a novel aspect of this invention.

Another aspect of the invention is summing of the monetary value of each type of symbol, and then multiplying the number of symbols accrued on a meter in the base game. There are no known games where there are different types of non-monetary credits awarded, and no games where the different monetary credits will have unique values attributed to each of the non-monetary credit units, with a resolution of monetary credits to the player.

According to an example of the invention, as shown in FIG. 1, referred to as SLOT MARKET, between one and the maximum number of symbol positions 20 (in this case, fifteen) are displayed. One or more symbol positions may be potentially wild "morphing" symbol positions 22. "Morphing" for purposes of this disclosure is a transformation of a game symbol into either another game symbol, a non-monetary credit symbol, into multiple game symbols within a given round of game play, or both. Morphing can be gradual or abrupt. The morphing symbol can have the appearance of an ordinary "wild" symbol, or can provide a visual indication that the symbol is wild as to only certain game symbols. The symbol can be animated—e.g. a spinning coin, can have sound features, etc.

This is distinguished from the known symbol transformations into representations of payouts, multipliers, free plays, and the like. There is a first traditional reel slot-type game in the play of the present invention. The initial play will usually resolve any awards for predetermined combinations of symbols, with or without wild morphing symbols 22. A single morphing wild symbol according to the invention can change into multiple symbol types in a single round of play, improving game outcomes on multiple pay line games. In addition, special non-monetary award events or symbols may be displayed. For example, a special non-monetary award certificate such as a utility stock certificate 24, commodity certificate 26 or technology certificate 28 symbol may be displayed. The display of the non-monetary award certificate(s), specific numbers of certificates, or certificates in specific positions or combinations of positions will cause an independent award of non-monetary credit awards. These awards may correspond to the appearance of the non-monetary award certificates, and more than one type of nonmonetary award certificate may be awarded in one play or in multiple plays of the underlying reel-type slot game.

These symbols are collected in an account (credit bank) and may be displayed in display area 30 and do not indicate any specific monetary value, although an artificial value may be displayed and even shown to vary before any bonus event occurs. For example, the player may be awarded technology stock certificates, commodity stock certificates, and utility stock certificates. Each of these may have a numeric identifier with them (e.g., 1 share, 10 shares, 10,000 shares, $10, etc.), even though the numeric identifier may have no actual value in the monetary credit accumulation of the underlying game. The certificates are collected for use in the bonus play of the SLOT MARKET™ game. In one example, all stock certificates (of different types) are accrued in a single pool of credits as shown in FIG. 1 (display area 30). Alternatively, different types of certificates can be accrued in separate accounts.

Figure 2:
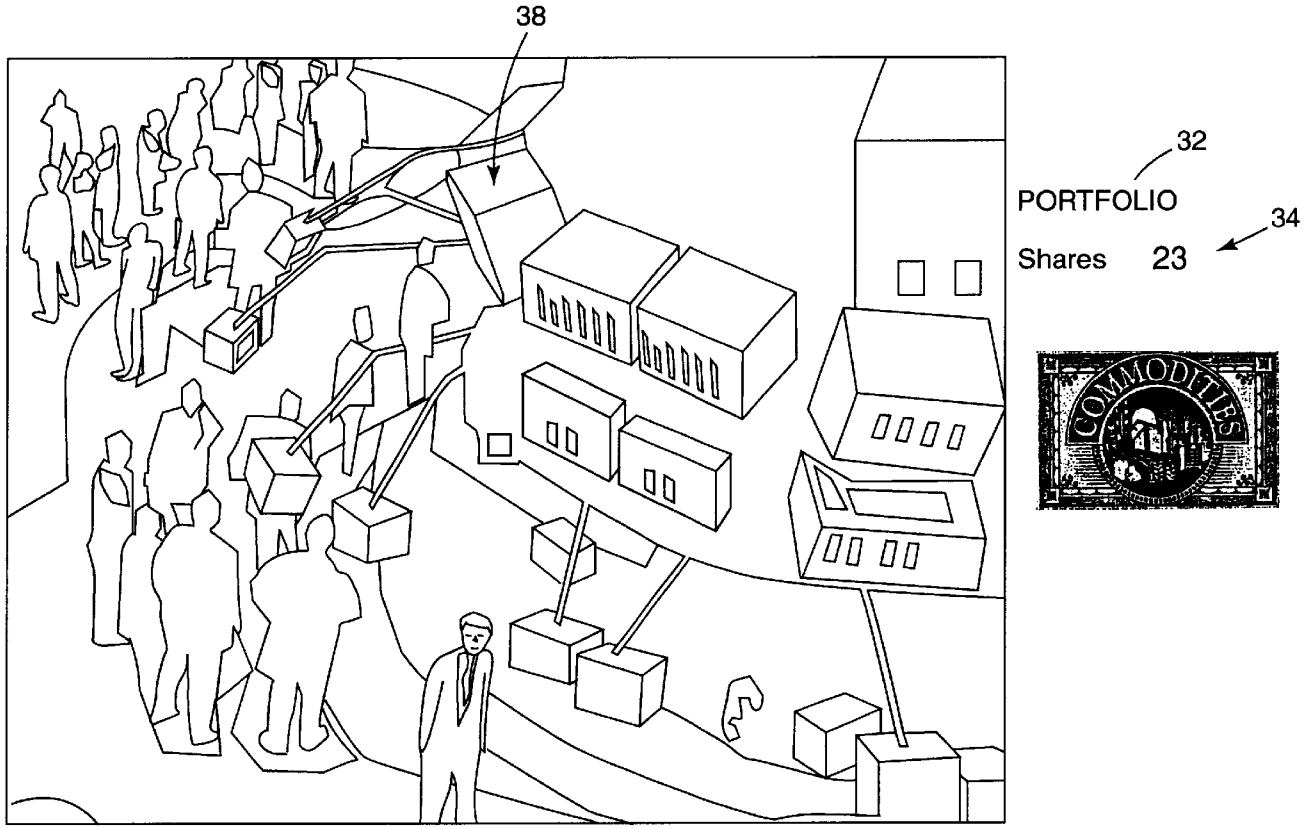
FIGS. 2 and 4 are screen displays of a bonus game segment of the present invention.

Upon entry into the bonus segment of the game as illustrated in FIG. 2, by whatever means that such entry is determined (e.g., a predetermined condition as discussed later herein), the portfolio of the player is displayed 32, with the number of certificates accrued in the base game shown 34. The screen then may indicate a change in unit value for the certificates 36, as if bidding/selling/trading is occurring. A stock board 38 may be shown, the totals of 'value' for each type of certificate may be shown changing, and then with a stock market closure (which may signaled by the traditional bell ending the session), the 'value' of each of the certificates, or at least one set of certificates (e.g., those certificates which are held in the greatest number by the player or the only type of single stock certificate held by the player) are then displayed 40 and then resolved with respect to the monetary credits of the player. According to this example of the invention, if the player does not advance to the bonus round, non-monetary credits continue to accumulate, but cannot be cashed out for monetary credit. The gaming device can be programmed so that after brief periods of inactivity, the non-monetary credit meter can be reset to zero, in response to a new player playing the game.

Figure 3:
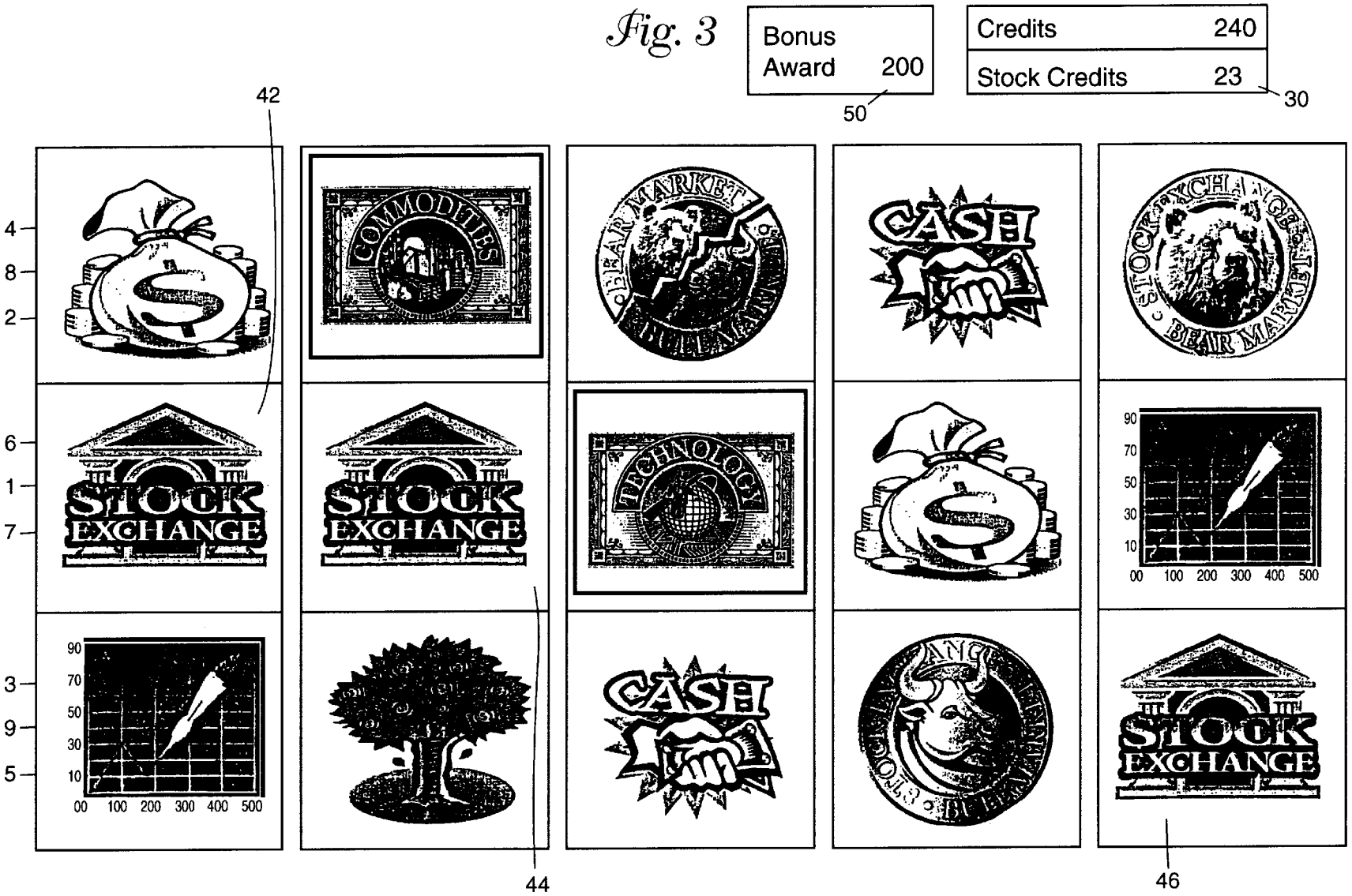

A typical type of base game display, as shown in FIG. 3 with all numbers and values being merely illustrative and not limiting, could include the following: A first three row by five column reel-type video wagering game could randomly display primary game symbols comprising a cash symbol, a money bag, a money tree, and the like. Also displayed in a random manner would be a) specific classes of certificates (as described before with technology stocks, commodity stocks, utility stock, etc.), b) Bull Symbols, Bear Symbols and Bull/Bear morphing wild symbols.

As the primary game is played, various combinations of the primary symbols produce typical payouts based upon combinations and arrangements of symbols on a pay line or as scatter pay events. In addition, the software keeps track of the number, position etc. of Bulls and the number, position etc. of Bears that appear on the display of the reel-slot gaming display. When certain combinations or numbers of Bulls or combinations or numbers of Bears in combination with a morphing Bull/Bear symbol appear on the display, the Bull/Bear symbol morphs into either the Bull, Bear or both symbols, and then back to the Bull/Bear symbol. The symbol will morph whenever its transformation into a Bull or Bear or both will produce a payout. The morphing wild symbols may be randomly displayed on the screen in one or more of the symbol positions.

In another example of the invention, when the Bull/Bear symbol appears in a position on the screen display where its transformation into a Bull, Bear or both produces one or more payouts, the symbol may first morph into a stock certificate. The stock certificate is awarded to the player and the total number of certificates, or each type of individual certificate may be displayed on the monitor.

If one of the predetermined events is an award of a non-monetary certificate when three Bear or Bull symbols appear in a row, the appearance of a morphing wild symbol adjacent two Bulls or two Bears would cause the morphing wild symbol to morph or change into a Bull or Bear to make three identical symbols. This change in the wild symbol would establish a predetermined event, and at least one stock certificate would be awarded to the player. After the morphing of the wild symbol into a Bull or Bear symbol, the wild symbol could then morph into a stock certificate. Alternatively, the wild symbol could morph into a stock certificate, then into a Bull or Bear symbol. Different amounts of stocks and different types of stocks could be awarded randomly, or in predetermined amounts (e.g. three credits per certificate displayed). Specific types of combinations (e.g., three Bears in a row) could be used as a basis for an award different numbers of stock certificates. These stock certificates have no monetary value at this point in the play of the game and are not playing or cash credits and cannot be converted to cash out credit or play credit unless or until the bonus round is achieved.

Figure 4:
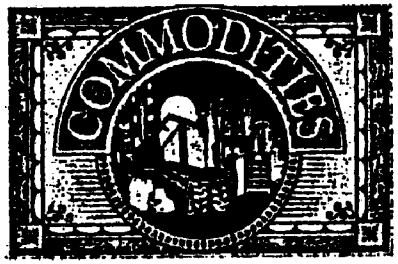
Figure 4:
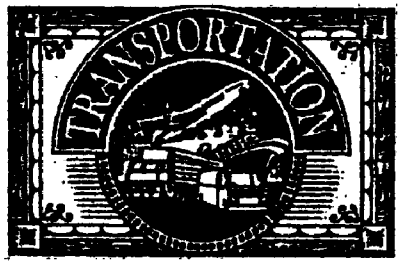
Figure 4:
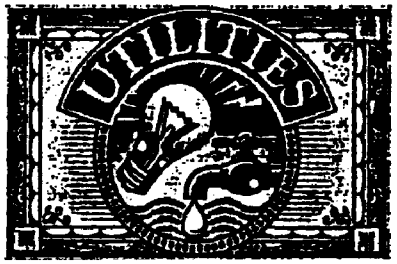
Figure 4:
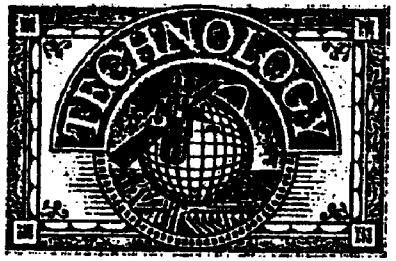
Figure 4:
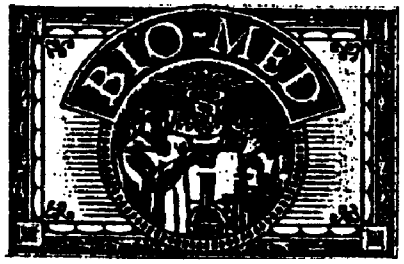

The bonus round or bonus play may again be attained by any designed predetermined event. In this case, the bonus round is initiated by the appearance of three stock market building symbols 42, 44, 46 in any arrangement on the screen as shown in FIG. 3. The occurrence of this predetermined event initiates or triggers the bonus event. This bonus event may begin with the ringing of a bell or buzzer or other audio and video displays, accentuating the opening of the stock market. The various stock certificates in the accumulated player portfolio are displayed and an artificial value for the stocks may be displayed. In one example of the invention, only one type of stock is accumulated in the base game. In this example, multiple types of stock certificates accrue on meter 30. Upon a triggering of the bonus event, the screen display as shown in FIG. 4, might show the different types of stock, 52, 54, 56, 58 and 60, and instruct the player to choose one type of stock to "trade". The screen features then indicates that a stock effecting event is occurring, such as bidding or selling of stock by any convenient image rendition (FIG. 2), such as the showing of a ticker tape, a ticker board, stock quotes moving on an overlay (as done on television shows along the bottom of the screen or elsewhere), or changing of 'values' shown adjacent to the stock certificates. The apparent changes in 'value' of the stock are displayed on the screen or the fact that apparent 'value' changes are occurring are intimated on the display. There is a final quotation for the stock certificates, and then there is a sale of the stock or other resolution that causes a bonus to occur. The payout can be the number of stock credits accrued on the meter 30, multiplied by the closing "price" of the stock. The bonus payout can be displayed in a Bonus display area 50. There may be sounds, video displays and other events (e.g., new flashes indicating market-affecting events such as a run-up on petroleum, new legislation affecting biological wastes, a drought in the corn belt, etc.) Upon resolution of the value of the stock, the credits from the stock transaction bonus event are awarded to the player.

The value of the stock may be shown and displayed in a number of ways. The stock may have a number of shares associated with them for each category. A tote board may show the credit value per share or per block of stock. The display of the credit value per share or per block is conveniently shown on the screen in an area adjacent to each block of stock held. These values are randomly determined. When the "market" closes, the value of the shares or the blocks of shares is displayed and the total value for each type of stock in which there is to be a bonus paid is displayed and then resolved, usually by crediting the players credit account. Not all blocks of stocks have to be awarded a payout amount. Some stock certificates may be declared valueless. A payout could be, for example, where five blocks of ten shares of biotech stocks have been awarded on a $1 minimum play video gaming system. The price of the blocks of stocks (each block being shown as ten shares of stock) is shown to vary between $0 and $10 per block. The final 'value' shown for the block of stocks is $2. The total credit value for the block of biotech stocks that is awarded as a bonus is therefore $2 times the five blocks or $10 bonus.

The selection of the particular block of stocks that is used in the bonus may be done in any convenient manner. All stock certificates may be evaluated. Only the stock with the highest number of shares may be considered. Any combination or intermediate basis of selection may be used.

In another example of the invention, multiple types of stock certificates are displayed, and are accrued in separate stock certificate accounts. For example, during play if three technology stock certificates and two utility stock certificate are accrued, the total number of each type of non-monetary stock credits are displayed. When the bonus event is triggered, separately, all accrued stocks are converted into the selected stock. A monetary value is then assigned to each type of stock, and the player receives a corresponding payout.

In another example, once the morphing wild symbols are displayed, or placed on the frames, and after the frames have stopped 'moving,' the appearance of the wild symbol changes or "morphs" into the selected symbol that may be modified or the payout may be increased in combination with that symbol, according to an example of the invention. Morphing may involve a continuous gradation of change from one image to another, with a gradual shift in the image components from the original image to the final image. The shift or change from the convertible wild symbol may also display a shift from one form to another through another form. For example, in the play of the game "SLOT MARKET™" according to the practice of the present invention, a symbol having indicia combining (half of one symbol and half of the other) both possible symbols that may be combined and the rank of the symbols affected by a Wild Symbol (e.g., a "Bull" or a "Bear"), the shift may include a transition to a stock certificate (one of the possible non-monetary credits that gives an appearance of value without actual intrinsic value in the accounting of the apparatus) and then to either a Bull or a Bear if either of those in the position of the wild symbol would enable an award of the non-monetary credit or effect a payout in play of the regular slot game. The wild symbol positions can be revealed to the player a number of other ways.

In one example, a standard game symbol first disappears and the wild symbol position is blank prior to the appearance of the wild symbol. In other examples, the game symbol transforms into the wild symbol. In yet other examples, the wild symbol appears on the game display along with other standard symbols as part of a game outcome. As a separate step, a marker appears on the screen display and a game symbol assigned to the same position as the marker disappears and is replaced with a wild symbol. The disappearance, as previously noted, may be a transmorphing from one symbol (the visual marker or visual marker and game symbol) into the wild symbol. Although morphing is preferred, a sharp, non-continuous change from the one symbol to the wild symbol may also occur.

The device of the present invention operates in the general manner of a typical video wagering reel-type slot gaming machine, with the specific improvements defined herein added to a wagering system. Images are provided of various frames representing positions on a virtual reel. The images are created and treated by the underlying apparatus (e.g., the microprocessor, computer, hardware, software, and the like) to give the appearance of the frames on the reel moving (usually revolving across the virtual reel) across the screen or being randomly displayed within the frames. As is typical with such video reel-type slot devices, the symbols stop, the system evaluates the types and number of symbols on pay lines, and a resolution of the game is provided.

The novel improvements that are added to the present invention may include at least one feature comprising a) a wild feature that may be applied towards only specific symbols that are potentially used in providing predetermined winning combinations or non-play credits towards an award, b) wild symbols that may morph into only specific symbols that are useful in providing winning combinations or non-play credits, c) non-play credits or awards that have no intrinsic value within the payout system of the game (yet may give an appearance of value), d) non-play credits that have no intrinsic value that may be collected in the play of the game and then have random values assigned to each unit of credit in determining a payout or bonus payout, e) awarding more than one symbol representing units of awards having no intrinsic value during play of the game and then randomly assigning values to the units, f) with the assigned values of e) having the potential for different values for at least two of the symbols, and g) the assignment of value(s) to the units of award appearing to randomly change or fluctuate, for example, as if representing a change in market value for the unit of award.

An Exemplary Operating System

The following discussion is intended to provide a brief, general description of suitable computing environments within which the invention may be implemented. While the invention will be described in the general context of an application program that runs on an operating system in conjunction with an operating system platform such as a personal computer, those skilled in the art will recognize that the invention may also be implemented in combination with other program modules. Generally, program modules include code, applets, routines, programs, components, objects, commands, data structure, etc. that perform particular tasks or implement particular abstract data types. Moreover, those skilled in the art will appreciate that the invention may be practiced with other computer system configurations, including hand held devices, multiprocessor systems, microprocessor-based or programmable consumer electronics, LAN (large area networks), WAN (wide area networks), microcomputers, mainframe computers, and the like. Multiple gaming devices may be operated out of a single mainframe or central series of computers. The invention may thus be practiced in distributed computing environments where tasks are performed by remote processing devices that are linked through a communication network. In a distributed computing environment, program modules may be located in both local and remote storage devices.

An exemplary, non-limiting system for implementing the present invention includes a conventional personal computer (also referred to as a client computer), including a processor or microprocessor, a system memory, and a system bus that couples the system memory to the processor. The system memory may include read only memory (ROM) and random access memory (RAM). A basic input/output system (BIOS) is usually stored in the ROM. The BIOS essentially contains the basic routines that help to transfer information between elements within the personal computer during certain computer operations, such as during start-up. The personal computer further may include a hard disk drive, a magnetic disk drive (e.g., that reads from and writes to a removable disk), and an optical disk drive (e.g., that reads from a CD-ROM disk or reads from or writes onto other optical media). The hard disk drive, magnetic disk drive, and optical disk drive may be connected to the system by any mechanism such as a hard disk drive interface, a magnetic disk drive interface, and/or optical disk drive interface, respectively. The drives and their associated computer-readable media provide nonvolatile storage for the personal computer. Although the description of computer readable media above includes the hard disk drive, a removable magnetic disk and a removable optical disk, such as a CD, its should be readily appreciated and understood by those of ordinary skill in the art that other types of media which are readable by computer or other artificial intelligence, such as magnetic cassettes, flash memory cards, flash memory disks, ZIP disks, digital video disks and tapes, Bernoulli cartridges, and the like, may also be used in the exemplary operating environment.

A number of program modules may be store in the drives and RAM, such as an operating system and a network browsing program module. In general, the network browsing program module is a tool used to interact with other computers over data networks, such as the internet and the World Wide Web. The network browsing program module is also a tool capable of using downloadable program modules, such as the puzzle control module, to direct operation of the personal computer. The drives and RAM may also store other program modules, program data (such as image data, player input data, random number generators, comparator data, look-up tables, and other game play data). The image capability of enabling morphing should also be included in the information system of the invention and well as other graphic enhancers.

The operating system, in conjunction with the BIOS and associated device drivers, may provide the basic interface between the computer's hardware and software resources, the user, and program modules such as the network browsing software module. A user may enter commands and information into the personal computer through a touch pad, activating buttons, button panels, touch screen surfaces, light wand surfaces, joy sticks, and/or a keyboard, and an input or pointing device such as a mouse. Other input devices may include a microphone (with voice recognition software), game pad, tracking ball, light gun, scanner, satellite dish, joy stick, light wand, or the like. These and other input devices are often connected to the processor through a serial port interface, such as a game port or a universal serial bus (USB). A monitor or other type of display device (e.g., a public view screen, integrated monitors, serial monitors, grid monitors, and the like, with any imaging format, such as CRT, plasma screen, projection viewing, liquid crystal display, light emitting diode (LED) display, etc.) is also connected to the system bus by way of an interface, such as a video adapter. In addition to the monitor, personal computers used in the gaming industry would typically include other peripheral output devices (not shown), such as peripheral light displays, audio systems, speakers, alarms, and the like.

As discussed earlier, the gaming system of the present invention is embodied in the housing, information storage, gaming modules and the like of the gaming apparatus as software, hardware or a combination of software and hardware. The information for particular games is typically stored in a game control module that essentially provides all of the information and controls and commands and responses in the play of he particular game of the invention. In one exemplary operating environment, the game control module is used in conjunction with a network browsing program module, which is supported by an available operating systems such as Microsoft Corporation's Windows 95," "Windows 98," "Windows NT," Microsoft Office" operating systems, LINUX, UNIX, MacIntosh Operating systems, or the like. However, it should be understood that the invention may be implemented for use with other network browsing program modules and with other operating systems and hardware, such as Microsoft Corporation's "Windows 3.1," "Windows 7.0" operating systems, IBM Corporation's "OS/2" and "AIX" operating systems, Sun-Soft Corporation's "SOLARIS" operating system, Hewlett-Packard Corporation's "HP-UX" and "RT-UX" operating systems, and the operating systems used in "MACINTOSH" computers manufactured by Apple Computer, Inc.

Figure 5:
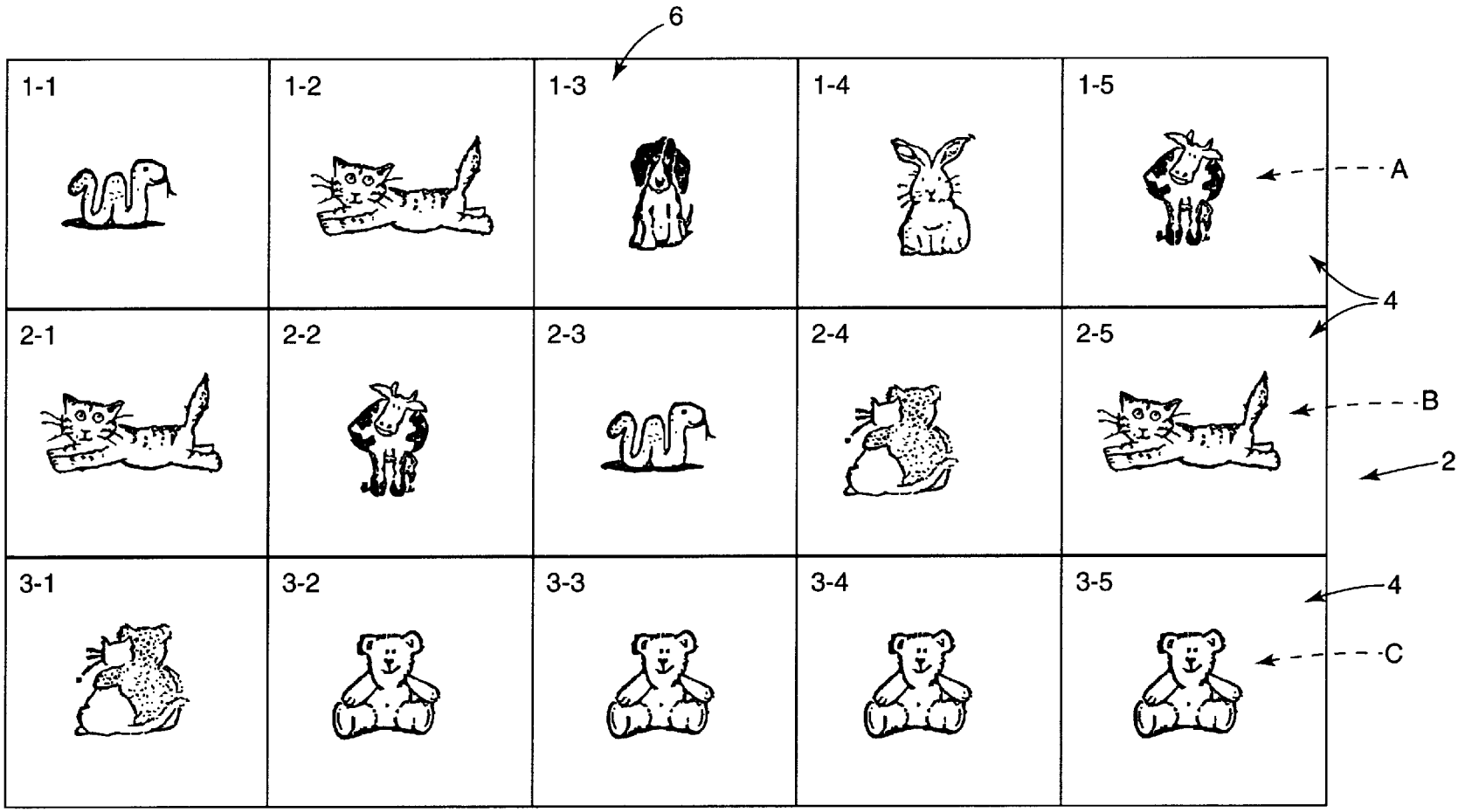
FIG. 5 shows the virtual frames of a video wagering game monitor with symbols displayed thereon.
Figure 6:
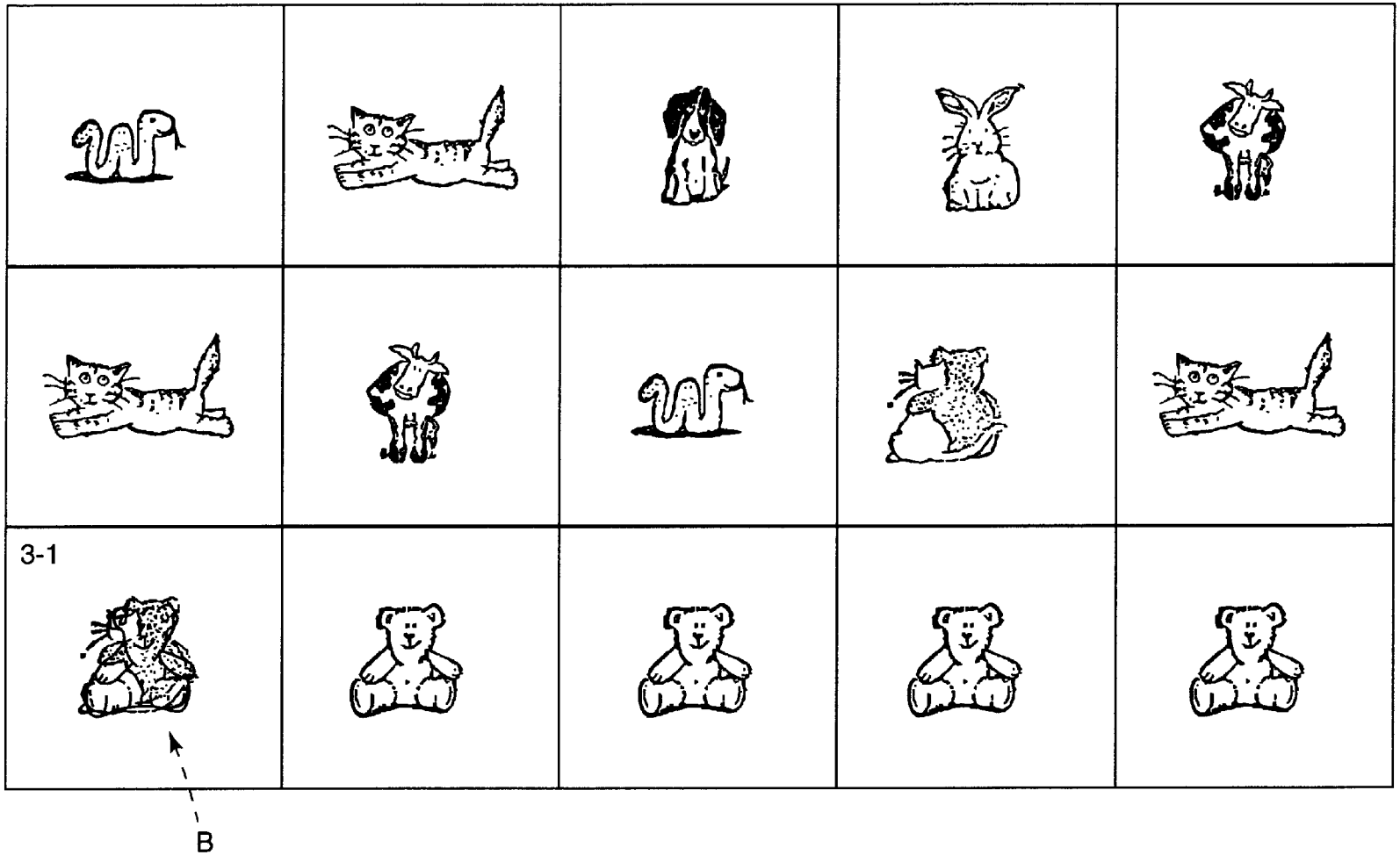
FIG. 6 shows the virtual frames of a video wagering game with an association of symbols in which one wild symbol is morphing into another symbol to form a combination of symbols that awards non-monetary credits to a player.

The play in a second example of the game will be explained in greater detail with respect to FIGS. 5–8 accompanying this text. FIG. 5 shows a video screen 2 with a first set of game images 4 thereon. Each of the frames has an identifier 6 shown for convenience in naming the respective frames. The numbers shown reflect first the row number and secondly the column number. To that end, the noted identifier 6 is shown as 1-3, row 1, column 3. Looking at the images 4, it should be apparent that none of the horizontal pay lines A, B or C appears to have a winning combination. However, the image in frame 3-1 is a combination of a bear and a cat. The play format of the game is such that only series of dogs, rabbits, snakes and cows provide first game winning combinations, but that bears and cats are "collectibles" with no monetary value, but which accumulate for later bidding. The image in frame 3-1 shows the combination of a bear and a cat and represents a morphing wild symbol. To that end, the morphing wild symbol in frame 3-1 will thereby enable five consecutive bears in pay line C. FIG. 6 therefore shows a morphing image 8 in frame 3-1. After this morphing image has completed its transition to a bear, five bears on pay line C exist, and a number of non-monetary bear credits such as 5, for example, would accumulate for the player. These non-monetary credits would accumulate until there was a triggering event in the play of the first game. That triggering event could be the appearance of two dog catchers in the same pay line. Upon the occurrence of that triggering event, the monitor screen would shift to the display of the accumulated credits and the variation in value of the accumulated credits.

Figure 7:
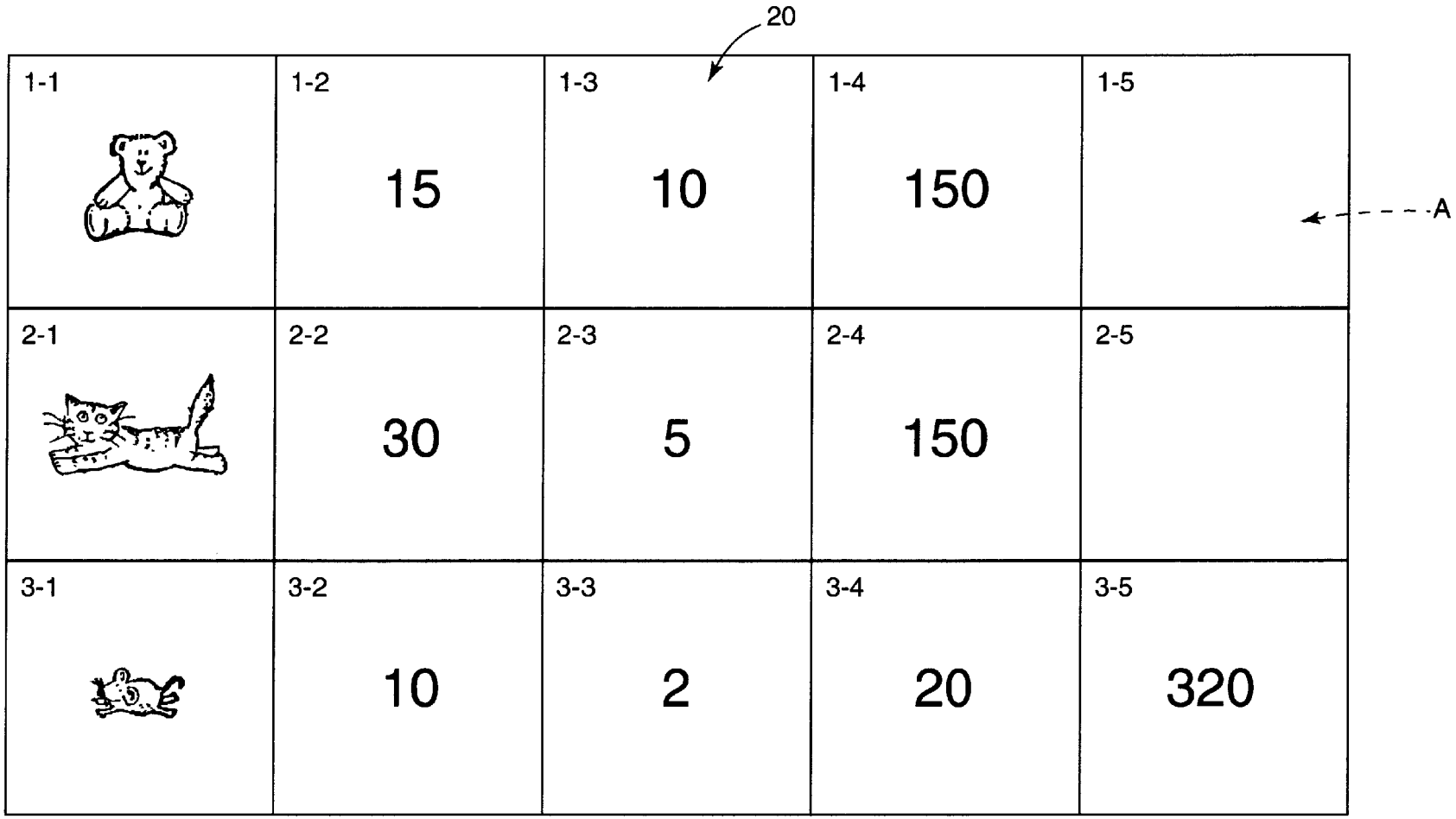
FIGS. 7 and 8 show screen displays illustrating how non-monetary cardits are converted to monetary credits.
Figure 8:
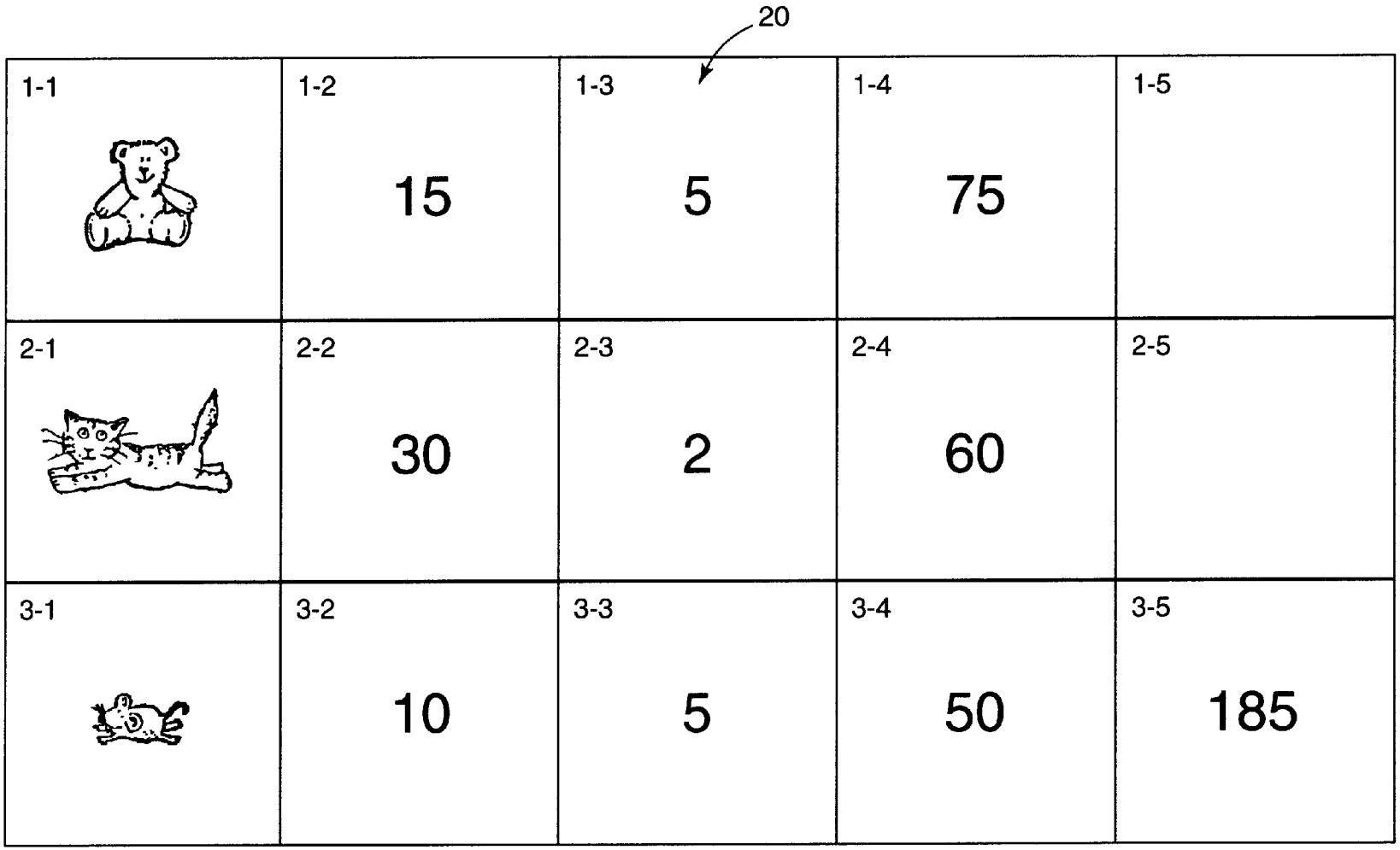

FIG. 7 shows a bidding board 20 for the animal commodities. Looking at the equivalent for pay line A on the board 20, frame 1-1 shows the 'commodity' of the bear, frame 1-2 shows the number of bears held by the player, frame 1-3 shows the value applied to each commodity, and frame 1-4 shows the total value of the accumulated bear commodities with that temporary valuation of the commodity. Frame 3-5 shows the total accumulated value of the commodities with the transient values shown. FIG. 4 shows the bidding board 20 with the final resolutions of the randomly assigned commodity prices.

The above examples have been illustrative of a generic scope of practice for the invention and are not to be taken as limitations on the practice of the invention. Equivalents and alternatives obvious to those skilled in the various relevant arts are intended to be used within the scope of practice of the present invention.

What is claimed is:

1. A method of playing a wagering game comprising:

placing a wager in a reel-type video wagering game, and playing a first game segment in the reel-type video wagering game in which symbols are randomly displayed to the player, wherein at least some displayed symbols may be non-monetary credit symbols, and during play of the first game segment, the player may accumulate the non-monetary credit symbols, upon the occurrence of a special feature or event, randomly assigning a monetary value to the non-monetary credit symbols, and resolving a payout based at least in part on the monetary value assigned to accumulated non-monetary credit symbols.

2. The method of claim 1, wherein the player accumulates non-monetary credits in the first game segment, and the random assignment of a monetary value or values to the non-monetary credits occurs in a second game segment.

3. The method of claim 2 wherein a predetermined event must occur in the play of the first game segment to allow resolution of the payout for the accumulated non-monetary credit symbols.

4. The method of claim 3 wherein the resolution of the payout for the accumulated non-monetary credit symbols includes displaying a variation of the apparent value of the non-monetary credit symbols and then displaying a final valuation of the non-monetary credit symbols.

5. The method of claim 2 wherein the monetary value assigned is randomly selected after playing the first game segment.

6. The method of claim 2 wherein an artificial monetary value is assigned during play of the first game segment and the resolution of the payout provides a different monetary value than the artificial monetary value.

7. The method of claim 2 wherein an artificial monetary value is assigned to non-monetary credit symbols before they are accumulated before play of the first game segment.

8. The method of claim 2 wherein non-monetary credit symbols are collected in at least two consecutive games and at the conclusion of the at least two consecutive games a payout is reconciled with the player with respect to a monetary value assigned to the non-monetary credit symbol.

9. The method of claim 1 wherein there is more than one type of non-monetary credit symbol(s) that may be awarded to the player.

10. The method of claim 9 wherein each of the more than one non-monetary credit symbol(s) has a monetary credit value assigned at the conclusion after playing said first game segment and the monetary value for each non-monetary credit symbol has the possibility of being different from the monetary credit value for at least one other non-monetary credit symbol.

11. The method of claim 10 wherein the monetary credit values for at least two non-monetary credit symbols are different.

12. The method of claim 11 wherein each of the monetary credit values for at least two non-monetary credit symbols are randomly selected.

13. The method of claim 9 wherein a total number of each type of non-monetary credit symbols is calculated, a value is assigned to each type of non-monetary credit symbols, and that value is multiplied by the total number of each type of non-monetary credit symbol.

14. The method of claim 1 wherein accumulated non-monetary credit symbols are displayed during play of the wagering game.

15. The method of claim 1 wherein play of the wagering game also allows a player to earn a bonus spin.

16. The method of claim 1 wherein the payout is resolved based only in part on the determined monetary value of accumulated non-monetary credits.

17. The method of claim 1 wherein the payout is resolved based only on the determined monetary value of accumulated non-monetary credits in a special feature or special event.

18. A method of playing a wagering game comprising:

placing a wager in a reel-type video wagering game, and playing a first game segment in the reel-type video wagering game in which symbols are randomly displayed to the player, wherein at least some displayed symbols may be non-monetary credit symbols, and after or during play of the first game segment, the player may accumulate the non-monetary credit symbols, upon the occurrence of a special feature or event, randomly assigning a monetary value to the non-monetary credit symbols, and resolving a payout based at least in part on the monetary value assigned to accumulated non-monetary credit symbols, wherein a first monetary credit value is shown for the non-monetary credit symbol, and that first monetary credit value is displayed to the player as changing.

19. A method of playing a wagering game comprising:

placing a wager in a reel-type video wagering game, and playing reel-type video wagering game in which symbols are randomly displayed to the player, wherein at least some displayed symbols may be used in defining monetary payouts and at least some symbols may be non-monetary credit symbols, also having morphing wild symbols available for display, the morphing wild symbols transforming to non-monetary credit symbols during game play.

20. The method of claim 19 wherein, the player may accumulate the non-monetary credit symbols, with or without using morphing wild credit symbols.

21. The method of claim 20 wherein a payout is resolved with the player with respect to a monetary value assigned to the non-monetary credit symbols after completion of play of the first game segment.

22. The method of claim 21 wherein resolution of the payout for the non-monetary credit symbols shows a variation of the apparent value of the non-monetary credit symbols and then a final valuation of the non-monetary credit symbols.

23. The method of claim 19 wherein a payout is reconciled with the player with respect to a monetary value assigned to the non-monetary credit symbols after completion of play of the first game segment.

24. The method of claim 19 wherein morphing wild symbols are displayed in a first game segment.

25. The method of claim 24, comprising a second gaming segment where the non-monetary credit symbols are assigned a monetary value, and wherein the non-monetary credits are converted to monetary credits.

26. The method of claim 25 wherein a payout is awarded with respect to a monetary value assigned to the non-monetary credit symbols after completion of play of the first game segment.

27. The method of claim 26 wherein a payout is resolved with the player with respect to a monetary value assigned to the non-monetary credit symbols after completion of play of the first game segment.

28. The method of claim 27 wherein resolution of the payout for the non-monetary credit symbols shows a variation of the apparent value of the non-monetary credit symbols and then a final valuation of the non-monetary credit symbols.

29. The method of claim 19 and further comprising the morphing wild symbol changing into another game symbol to cause or increase a payout in the game.

30. A method of playing a wagering game comprising:

placing a wager in a reel-type video wagering game, playing the reel-type video wagering game in which symbols are randomly displayed to the player, wherein at least some displayed symbols may be used in defining monetary payouts and at least some symbols may be non-monetary credit symbols, also having morphing wild symbols available for display, the morphing wild symbols morphing into at least one of other game symbols and non-monetary credit symbols.

31. The method of claim 30, and further comprising the step of assigning a monetary value to the non-monetary credit symbols.

32. The method of claim 31, wherein a payout is based on one or more of a) ordinary game symbol combinations; 2) a combination of game symbols and morphing wild symbols; and c) the monetary value of the non-monetary credit symbols.

33. A method of playing a wagering game comprising:

placing a wager in a reel-type video wagering game, and playing a first game segment in the reel-type video wagering game in which symbols are randomly displayed to the player, wherein at least some symbols available for display are non-monetary credit symbols, and where non-monetary credit symbols are accumulated as the non-monetary credit symbols are displayed during game play, wherein an accumulation of non-monetary game credits continues until occurrence of a special feature or event that provides a monetary award based upon a number of non-monetary credits accumulated;

in the special event or feature, monetary value is randomly assigned to non-monetary credit symbols and the monetary value of accumulated non-monetary credits is determined, and a payout is resolved based at least in part on the determined monetary value of accumulated non-monetary credits.

34. The method of claim 33 wherein the payout is resolved based only in part on the determined monetary value of accumulated non-monetary credits.

35. The method of claim 33 wherein the payout is resolved based only on the determined monetary value of accumulated non-monetary credits in a special feature or special event.

36. A method of playing a wagering game comprising:

placing a wager in a reel-type video wagering game, and playing a first game in the reel-type video wagering game in which symbols are randomly displayed to the player, wherein at least some displayed symbols may be non-monetary credit symbols, and the player accumulates non-monetary credits and information is stored on the total of each type of non-monetary credit accumulated, only upon the occurrence of a special feature or special event, randomly assigning a monetary value to the non-monetary credit symbols, the player selecting at least one non-monetary credit symbol for play in a payout feature that occurs after the special feature or special event, and resolving in a payout feature a payout based at least in part on the monetary value assigned to accumulated non-monetary credits associated with the selected non-monetary credit symbols.

37. The method of claim 36 wherein the player selects only one non-monetary credit symbol for play in the payout feature.

38. A method of playing a wagering game comprising:

placing a wager in a wagering game, and playing a first game segment in the wagering game in which symbols are randomly displayed to the player, wherein at least some displayed symbols may be non-monetary credit symbols, and during play of the first game segment, the player may accumulate the non-monetary credit symbols, upon the occurrence of a special feature or event, randomly assigning a monetary value to the non-monetary credit symbols, and resolving a payout based at least in part on the monetary value assigned to accumulated non-monetary credit symbols.

39. The method of claim 38 wherein the wagering game is computer controlled.

* * * * *

UNITED STATES PATENT AND TRADEMARK OFFICE

CERTIFICATE OF CORRECTION

PATENT NO. : 6,311,976 B1 
DATED : November 6, 2001
INVENTOR(S) : Mark L. Yoseloff, Russell B. Dunn and Josef Alexander Hartl It is certified that error appears in the above-identified patent and that said Letters Patent is hereby corrected as shown below:

Title page,
Item [73], insert -- Shuffle Master, Inc., Eden Prairie, Minnesota --

Signed and Sealed this

Fifth Day of November, 2002

*Attest:*

*Attesting Officer*

JAMES E. ROGAN
*Director of the United States Patent and Trademark Office*